United States Patent [19]

Hogan et al.

[11] Patent Number: 4,823,833

[45] Date of Patent: Apr. 25, 1989

[54] FLUID COMMUNICATION DEVICE

[75] Inventors: Lawrence R. Hogan, Lake Villa; Herbert Mittleman, Deerfield; Edward G. Oilschlager, Lake Villa; Ellen Rouch, Ingleside; William L. Rudzena, McHenry, all of Ill.

[73] Assignee: Baxter Healthcare Corporation, Deerfied, Ill.

[21] Appl. No.: 648,630

[22] Filed: Sep. 11, 1984

Related U.S. Application Data

[63] Continuation of Ser. No. 391,784, Jun. 24, 1982, abandoned.

[51] Int. Cl.[4] ..... E03B 15/00

[52] U.S. Cl. ..... 137/567; 251/6; 604/82; 604/258; 604/905

[58] Field of Search ..... 137/567, 605, 263, 602; 141/9, 67, 105, 234, 235, 236, 331; 220/306, 339, 375; 251/6; 604/258, 259, 905, 82

[56] References Cited

U.S. PATENT DOCUMENTS

| | | | |
|---|---|---|---|
| 1,686,003 | 10/1928 | Hottinger | 251/6 X |
| 1,848,024 | 3/1932 | Owen | 417/477 |
| 3,565,286 | 2/1971 | Latham, Jr. | 222/4 |
| 3,749,285 | 7/1973 | Latham, Jr. | 222/58 |
| 3,851,646 | 12/1974 | Sains | 137/602 X |
| 3,941,126 | 3/1976 | Dietrich et al. | 141/107 X |
| 4,006,847 | 2/1977 | Dooley | 222/263 |
| 4,036,357 | 7/1977 | Czeler | 220/375 X |
| 4,132,225 | 1/1979 | Whattam | 220/375 X |
| 4,143,853 | 3/1979 | Abramson | 251/149.1 |
| 4,150,673 | 4/1979 | Watt | 141/329 X |
| 4,191,183 | 3/1980 | Mendelson | 604/83 X |
| 4,197,848 | 4/1980 | Garrett et al. | 128/247 |
| 4,296,785 | 10/1981 | Vitello et al. | 141/105 |
| 4,347,874 | 9/1982 | Sullivan et al. | 141/1 |

FOREIGN PATENT DOCUMENTS

| | | | |
|---|---|---|---|
| 1087062 | 2/1955 | France | 141/331 |

*Primary Examiner*—William A. Cuchlinski, Jr.
*Attorney, Agent, or Firm*—Paul Flattery; Kay H. Pierce; Brad Price

[57] ABSTRACT

The present invention provides a sterile, unitized, economical device furnishing a fluid path between a plurality of solutions to be compounded and a receiving container. The device includes a plurality of fluid connectors and fluid lines sealingly connected to respective pump fittings which provide individual paths to a common junction block.

The common junction block includes a portion for receiving fluid lines and preventing them from crimping thereby maintaining fluid flow. The block also includes an exit port for providing a sealingly sterile connection to the receiving container. Further, a closure is provided to protect the exit port from contamination when the port is not providing fluid communication to the receiving container.

29 Claims, 2 Drawing Sheets

FLUID COMMUNICATION DEVICE

This application is a continuation of application Ser. No. 391,784, filed June 24, 1982 now abandoned.

BACKGROUND OF THE INVENTION

The present invention pertains to a fluid communication device for mixing and transferring solutions. More particularly, it pertains to a device especially useful in high speed compounding of hyperalimentation solutions.

Hyperalimentation therapy is the intravenous feeding of, for example, a protein-carbohydrate mixture to a patient. It is used primarily to meet the patient's protein and caloric requirements which are unable to be satisfied by oral feeding. The protein may be in the form of free-amino acids or protein hydrolysate and the carbohydrate commonly is dextrose. In addition to the protein and carbohydrate, vitamins (water-soluble and fat-soluble) and electrolytes also can be supplied in this therapy.

Each of these parenteral ingredients and the combination thereof are particularly susceptible to the growth of deleterious organisms and it is desirable that they be administered to the patient in a sterile condition. Thus, because these protein and carbohydrate solutions cannot be pre-compounded by the manufacturer, but must be combined at the time of their use, their compounding must be performed under sterile conditions to avoid organism growth.

A known apparatus and process for compounding hyperalimentation solutions utilizes a solution transfer system including a receiving container and a Y-transfer set. The Y-transfer set includes two separate tubes, each having an end attached to a common juncture by which solutions delivered through the tubes will pass through the juncture into the receiving container. The other end of one tube of the set is attached to the protein holding container and the other end of the other tube of the set to the carbohydrate holding container. The desired volume of each solution being transferred to the container is controlled by a clamp placed on each tube. The solutions may be allowed to flow into the receiving container by gravity flow. However, it has been found to be useful to transfer the solutions under the influence of a vacuum applied to the receiving container. When the receiving container is a flexible plastic container, the vacuum is created in a vacuum chamber into which the container is placed.

It has been known in the past that to ensure sterility during the compounding of hyperalimentation solutions, compounding should be performed under a laminar flow hood. Laminar flow hoods are used for reducing the risk of air-borne contamination of such solutions. These units operate by taking room air and passing it through a pre-filter to remove gross contaminates, such as dust and lint. The air is then compressed and channeled through a bacterial retentive filter in the hood in a laminar flow fashion. The purified air flows out over the entire work surface of the hood in parallel lines at a uniform velocity. The bacterial retentive type of filter is designed to remove all bacteria from the air being filtered.

Compounding under a laminar flow hood aids in preventing airborne contamination, but it is relatively cumbersome and expensive and would not be useful for eliminating any other source of contamination, such as contamination caused by handling. When using a hood the operator may inadvertently perform the work at the end or outside of the hood and not within the recommended space, at least six (6) inches (15.24 centimeters) within the hood, which insures the benefits of the air being purified. Time must be taken and care must be exercised to maintain a direct open path between the filter and the compounding area. Solution bottles and other nonsterile objects cannot be placed at the back of the hood work area next to the filter because these objects could contaminate everything downstream and disrupt the laminar flow pattern of the purified air. Also, in using a laminar flow hood, it is necessary routinely to clean the work surface of the hood before any compounding is performed.

Thus, the prior art apparatus and process discussed above are disadvantageous due to the extensive number of hand operations which are time consuming and can be error prone.

An apparatus and process utilizing a filter system in the compounding operation poses new problems. The viscosities of some of these parenteral solutions could cause filter clogging and, consequently, retard transfer through the filter and apparatus. Also, the viscosities of the solutions may be and are generally different, which could lead to an unequal or otherwise undesired mixture of them. Therefore, additional time and care must be exercised to ensure that the desired mixture of the solutions being combined is achieved.

A process and apparatus that overcomes the above-discussed disadvantages has been developed. This process and apparatus is disclosed and claimed in co-pending U.S. application No. 391,759 filed concurrently herewith, in the names of Carl Miller and Lawrence R. Hogan for HIGH SPEED BULK COMPOUNDER which application is assigned to the assignee of the present invention and is incorporated herein by reference now U.S. Pat. No. 4,513,796.

As disclosed therein, quick and accurate delivery of fluids for compounding, especially sterile fluids, is accomplished by sequentially controlled peristaltic pumps operatively connected between the solution containers and a receiving container. A controller receives data from an operator on the amount, by volume, of each solution to be compounded and its specific gravity. The comparison of this data to the weight sensed in a collection container permits the controller to sequentially operate the pumps. The controller is also able to monitor various process conditions. Failure to achieve these process conditions results in an automatic shutdown of the operation.

The device of the present invention provides a unitized, sterile, quick and economical fluid path to be used with the aforementioned HIGH SPEED BULK COMPOUNDER. Also, the device is arranged to provide proper orientation with respect to the compounding apparatus.

SUMMARY OF THE INVENTION

In accordance with the present invention, a device for fluid communication is provided to be used with an apparatus for compounding a plurality of solutions, preferably under sterile conditions. The device of the present invention includes a plurality of fluid container connectors to be inserted into respective solution containers, each container containing a solution to be compounded. Fluid lines sealingly connect each container connector to a respective inlet pump fitting for providing fluid flow from the solution containers to a respective pump tube.

The pump tubes are elastomeric bodies fluidly connecting respective inlet pump fittings to exit pump fittings. The pump fittings include grips about their periphery to facilitate putting the pump tubes in tension about pump rollers of peristaltic pumps of the compounder. Tension of the pump tubes is maintained by placing the pump fittings in respective inlets and exits provided in the housing of the compounder.

The exit pump fittings are sealingly connected to further fluid lines to provide a fluid path to a common junction block. The junction block separately receives each of the plurality of further fluid lines in a substantially parallel, vertically spaced manner so as not to inhibit fluid flow by crimping of the lines.

The common junction block provides an exit port for sealingly and sterilely receiving a further fluid connector to provide a path to a receiving container. The exit port is preferably at right angles to the entrance of the plurality of further fluid lines.

The common junction block also has a closure member associated therewith to cover the exit port and protect it from contamination when not in use. The closure member includes a retaining ring, securing the member to the block, connected to a closure by a flexible member. In the block use or uncovered position, the ring, flexible member and closure lie in a substantially common plane with the internal side of the closure facing downward to prevent collection of particulate contamination on the interior thereof. In the block non-use or covered position, the flexible member is rotated to allow the interior of the closure to cover the exit port.

One of each set of inlet and exit pump fittings are color or numerically coded to correspond to a respective pump of the compounder to provide proper orientation of the present invention with respect to the compounder. Further, the fluid lines are sized to provide the exact requirements of length for the compounder. Preferably the device is constructed to accommodate three solutions to be compounded. The device of the present invention provides a sterile, unitized, economical fluid path between solution containers containing solutions to be compounded and a receiving container.

BRIEF DESCRIPTION OF THE DRAWINGS

FIG. 2 is a perspective view configured in accordance with the present invention;

DETAILED DESCRIPTION

Figure 1:
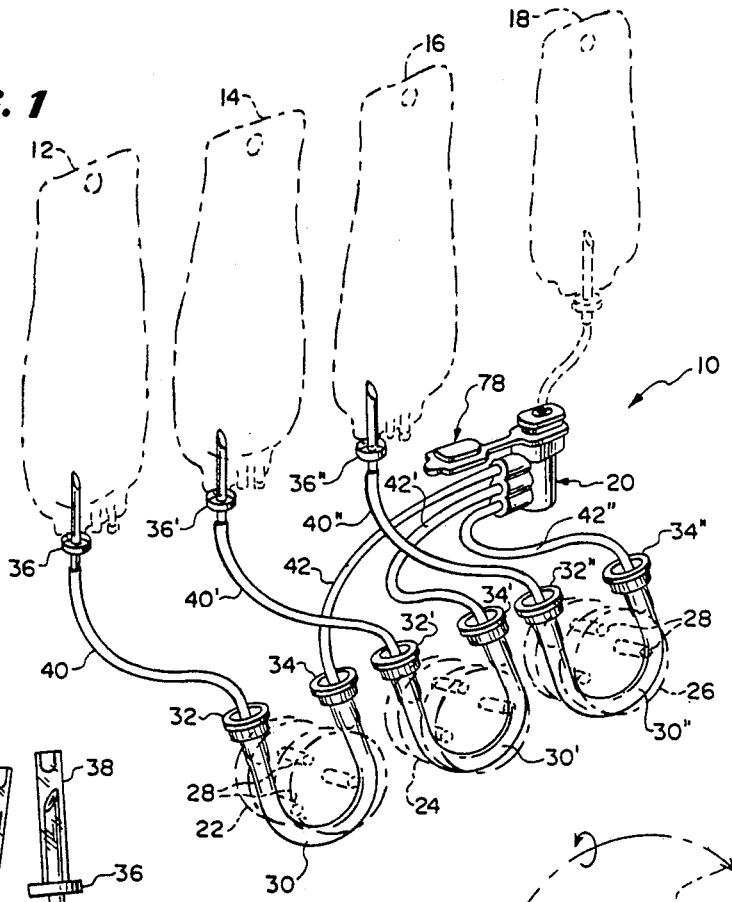
FIG. 1 is a perspective view of the present invention in accordance with its use as providing a fluid path.

Referring now to FIGS. 1 and 2, a fluid communication device 10 of the present invention is best illustrated. FIG. 1 shows the device 10 in position for use with the HIGH SPEED BULK COMPOUNDER, while FIG. 2 shows the device 10 as it is removed from its sterile package. Supply containers 12, 14 and 16, shown in phantom in FIG. 1, are fluidly connected with a receiving container 18 (also shown in phantom) by device 10. The supply and receiving containers which are shown in phantom may be flexible plastic bags of the type marketed by Travenol Laboratories, Inc. of Deerfield, Ill. under the register trademark VIAFLEX.

The device 10 provides a sterile fluid path from each supply container to a common junction block 20, where a receiving container can be placed in fluid communication therewith. The solutions to be compounded are transferred from the supply containers to the receiving container by peristaltic pumps 22, 24 and 26 (shown in phantom). The peristaltic pumps 22, 24 and 26 effect fluid flow from the supply containers 12, 14 and 16 through the device 10 to the receiving container 18 by movement of rotatable rollers 28 of each pump which compress respective tensioned wall portions 30, 30' or 30'' of the fluid path in contact therewith, forcing the fluid therein forward.

The portion 30, 30' and 30'' of the fluid paths of device 10 in contact with each respective pump is an elastomeric body or pump tubing from about four inches (10.16 centimeters) to about six inches (15.24 centimeters) long, preferably five inches (12.7 centimeters) long, capable of being put in tension. The ends of each pump tubing 30, 30' and 30'' are connected to respctive inlet and exit pump fittings 32, 32' and 32'' and 34, 34' and 34'' respectively, which are operatively fixed in position to maintain the pump tubing in tension, such as placed within inlet and exit slots of a pump housing (not shown).

The fluid paths of device 10 start with fluid connectors 36, 36' and 36'. The tips of the fluid connectors 36, 36' and 36'' are adapted to be inserted into the supply containers 12, 14 and 16 respectively and prior to their use are covered with a protective sheath 38, 38' and 38'' (FIG. 2) to prevent contamination of the connectors and the fluid paths. Each fluid connector is sealingly connected to a respective fluid line 40, 40' and 40'', such as vinyl tubing or the like which are sealingly connected to a respective inlet pump fitting 32, 32' and 32''. Further fluid lines 42, 42' and 42'' are each sealingly connected to a respective exit pump fitting 34, 34' and 34'' to connect it with the common junction block 20.

Figure 4:
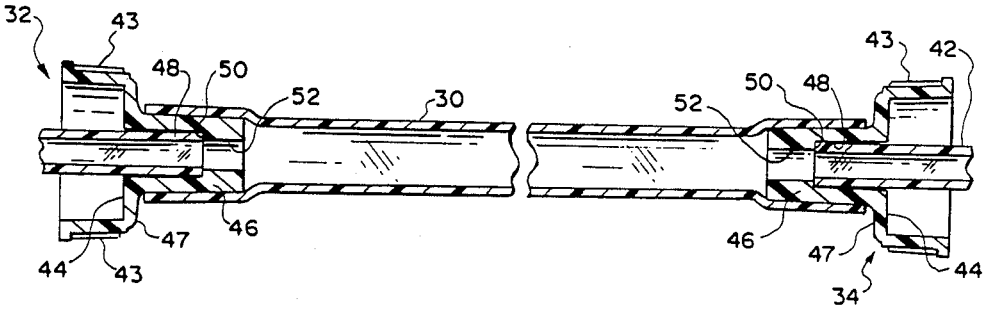
FIG. 4 is a sectional view of another portion of the present invention.

The inlet and exit pump fittings 32 and 34 as seen in FIG. 4 are representative of like fittings and tubings of device 10. The inlet and exit pump fittings have a ribbed portion 43 around their periphery. This ribbed portion 43 facilitates their gripping to place pump tubing 30 in tension around rollers 28. The inlet and exit pump fittings 32 and 34 are identical and have a dish shaped portion 44 at one end connected to a cylindrical portion 46 at the other end providing a shoulder portion 47. The shoulder portion 47 bears against the inlet or exit slots of the pump housing to maintain tension in the pump tubing 30 connected thereto. The pump tubing 30 is stretched over the cylindrical portion 46 of the fittings 32 and 34 to provide an interference fit therebetween. The cylindrical portion 46 includes a cylindrical fluid line receiver 48 tapered along its length therein having a shoulder portion 50. The fluid line is inserted into the cylindrical portion 46 through the dish shaped portion 44 until it contacts the shoulder 50. The line is then sealed therein. The cylindrical portion 46 then provides fluid communication through a hollow cylindrical portion 52.

The fluid lines 40, 40' and 40'' coupling respective fluid connectors 36, 36' and 36'' to respective inlet pump fittings 32, 32' and 32'' are preferably of the same length. The fluid lines 42, 42' and 42'' coupling the exit pump fitting 34, 34' and 34'' to the common junction block 20 are preferably of differing lengths to accommodate differences in the spatial relation of each pump 22, 24 and 26 to the block 20. Further, at least one of each set of inlet and exit pump fittings are either numerically, color or otherwise coded to correspond to a respective coded operative position to provide proper orientation of the device 10.

Figure 3:
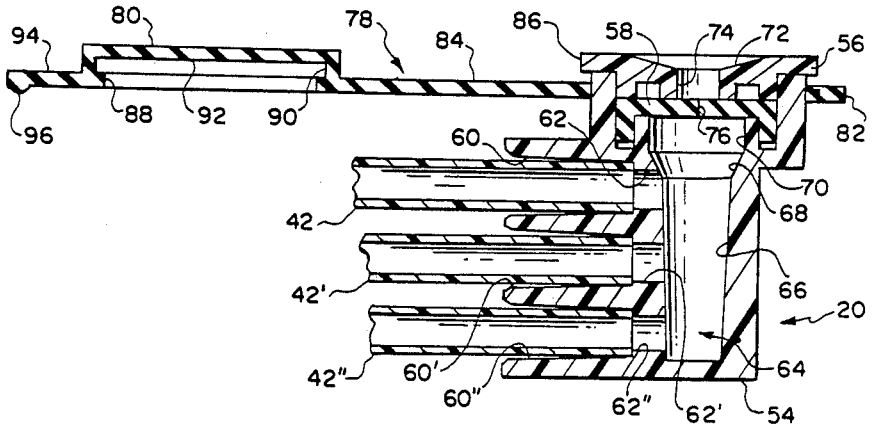
FIG. 3 is a sectional view of a portion of the present invention.

The common junction block 20 is best seen in FIG. 3. The block 20 includes a junction body 54, a top cap 56 and a membrane 58 therebetween. The body 54 provides substantially parallel, vertically spaced tapered channels 60, 60' and 60'' which are each adapted to receive a respective fluid line 42, 42' and 42'' so as not to inhibit fluid flow therethrough by crimping of the lines. The channels 60, 60' and 60'' are tapered to provide a snug fit for fluid lines 42, 42' and 42'' which are sealingly connected therein. Ports 62, 62' and 62'' provide fluid communication between a respective channel and a small volume chamber 64. The chamber 64 is at substantially right angles to the channels and ports and is of an inverted truncated cone shape 66 leading into another more pronounced inverted truncated cone shape 68 leading into a cylindrical portion 70.

The top cap 56 is sealed, such as by welding, to the upper portion of the body 54 and secures the membrane 58 therebetween. The top cap 56 provides a dish shaped opening 72 leading in a channel 74 which provides communication with the membrane 58. The membrane 58 has a normally closed, resiliently deformable slit 76 which extends therethrough. The slit 76 provides a sealed sterile fluid path for the entrance of a fluid connector or the like to provide a fluid path to the receiving container. This is accomplished by the membrane 58 deforming and closing about the connector. Upon withdrawal of the connector the membrane 58 will close upon itself immediately, thereby continuing to protect the fluid path of the device 10. The top cap, membrane and slit are of the type disclosed in U.S. Pat. No. 4,197,848 which issued in the names of Scott T. Garrett, Robert R. Fasana and William L. Rudzena.

A closure or dust cover 78 is provided to protect the fluid path of device 10 when not inuse. The cover 78 includes a closure member 80, a connecting member 82 and a flexible arm 84 therebetween. The connecting member 82 is ring-like and fits around the periphery of the upper end portion of the junction body 54. The top cap 56 is provided with a lip 86 at its upper end portion to prevent the member 82 from becoming dislodged from the junction body 54 and to provide a sealed connection with member 80.

The flexible arm 84 connects the connecting member 82 and the closure member 80. The arm 84 maintains the members 80 and 82 in the substantially same plane and out of the way of the functional area when not used to protect device 10, but allows easy access when needed.

The closure member 80 includes lip 88 and undercut 90 which are complemental with lip 86 of the top cap 56 to provide a sealed enclosure about the top cap 56 thereby protecting the fluid path of device 10. The member 80 is orientated with its internal side 92 facing downward, when not used to protect device 10, to prevent any particulate matter from accumulating thereon. The member 80 when sealingly covering top cap 56 requires the flexible arm 84 to be rotated or twisted about its axis to provide the proper orientation of the closure 80 with respect to the top cap 56. The member 80 also includes a pull tab 94 with a raised gripping area 96 for easy grasping of the tab 94 to facilitate the uncovering of the top cap 56.

The device 10 of the present invention hereinabove described provides a unitized, sterile, economical fluid path between a plurality of solution containers containing solutions to be transferred to a receiving container. The device is especially adapted for use with the HIGH SPEED BULK COMPOUNDER to provide a fast, efficient, precise, sterile way of compounding solutions. Further, the device 10 provides the proper orientation of the device with respect to the compounder to prevent errors.

Modification and variations of the present invention are possible in light of the above teachings. It is therefore, to be understood that within the scope of the appended claims, the invention may be practiced otherwise than as specifically described.

What is claimed and desired to be secured by Letters Patent of the United States is:

1. A fluid communication device for a high speed bulk compounder comprising:

a plurality of first fluid lines, each said first fluid line connecting a respective fluid connector to a respective first pump fitting providing a fluid path therebetween;

a plurality of pump tubing segments maintained in tension connecting each said respective first pump fittings to respective second pump fittings furnishing a fluid path therebetween;

a plurality of second fluid lines, each said second fluid line connecting each said respective second pump fitting to a common junction block; and said common junction block including a fluid passageway in fluid communication with each said second fluid line, a chamber in fluid communication with the fluid passageway, and exit port means therein communicating with such chamber for providing a path for further fluid communication external said junction block, said common junction block further including a closure to cover said exit port means to prevent particulate matter from accumulating thereon, said closure including a retaining ring securing said closure to said common junction block and a flexible member connecting said retaining ring to said closure and said closure, flexible member and retaining ring lying in substantially the same plane when said exit port means is uncovered.

2. The device as claimed in claim 1 wherein said fluid paths are sealingly connected.

3. The device as claimed in claim 2 wherein said pump tubing segments are connected to said pump fittings by an interference fit therebetween.

4. The device as claimed in claim 1 wherein each of said second fluid lines is of a different length.

5. The device as claimed in claim 1 wherein each of said pump tubing segments is an elastomeric body adapted to be put in tension.

6. The device as claimed in claim 5 wherein each of said pump tubing segments is adapted to be placed in tension around associated rollers of respective peristaltic pumps to achieve fluid flow therethrough.

7. The device as claimed in claim 1 wherein the length of each of said pump tubing segments is from about four inches to about six inches.

8. The device as claimed in claim 7 wherein the length of each of said pump tubing segments is about five inches.

9. The device as claimed in claim 1 wherein said pump fittings include gripping means about their periphery adapted to aid in placing said pump tubing segments in tension.

10. The device as claimed in claim 1 wherein at least one of each set of first and second pump fittings is coded to provide proper orientation to a respective coded operative position.

11. The device as claimed in claim 1 wherein said exit port means is adapted to sealingly receive a further fluid connector to provide a path for fluid communication.

12. The device as claimed in claim 1 including:

three first fluid lines, each said first fluid line connecting each said respective fluid connector to a respective first pump fitting providing a fluid path therebetween;

three pump tubing segments connecting each said respective first pump fitting to each said respective second pump fitting furnishing a fluid path therebetween; and three second fluid lines, each said second fluid line connecting each said respective second pump fitting to said common junction block.

13. A fluid communication device for providing quick and accurate delivery in a bulk compounder comprising:

a plurality of first fluid lines, each said first fluid line sealingly connecting a respective fluid connector to a respective first pump fitting providing a fluid path therebetween;

a plurality of pump tubing segments maintained in tension sealingly connecting each said respective first pump fittings to respective second pump fittings furnishing a fluid path therebetween;

said pump fittings include gripping means about their periphery adapted to aid in placing and maintaining said pump tubing segments in constant tension;

at least one of each set of first and second pump fittings is coded to provide proper orientation to a respective coded operative position for correct use;

a plurality of second fluid lines, each said second fluid line sealingly connecting each said respective second pump fitting to a common junction block; and said common junction block including a fluid passageway in fluid communication with each said second fluid line, a chamber in fluid communication with the fluid passageway, and exit port means therein communicating with said chamber for providing a path for further fluid communication external said junction block, the chamber is at substantially right angles to the second fluid lines and defines a substantially truncated cone-shaped volume.

14. A fluid communication device for use with a high speed bulk compounder comprising:

a first fluid line extending from a fluid connector;

a second fluid line extending from a common junction block;

a pump tube including pump fitting means for securing an end of the pump tube to the first fluid line and a second end of the tube to the second fluid line, the first fluid line, second fluid line, and pump tube defining a fluid passageway from the fluid connector to the common junction block;

the pump fitting means cooperating with the compounder to maintain the pump tube in a constant tensioned state; and the common junction block including means for defining a minimum volume chamber and chamber means for receiving an end of said second fluid line to provide fluid communication between the minimum volume chamber and second fluid line, said minimum volume chamber defines at least one truncated cone-shaped volume.

15. The device of claim 14 wherein the pump fitting means orients the pump tube with respect to a roller of the compunder.

16. A fluid communication device for use with a high speed bulk compounder including at least one roller comprising:

a first fluid line extending from a fluid connector;

a second fluid line extending from a common junction block;

a pump tube including pump fitting means for securing the pump tube around the roller in a tensioned state;

the first fluid line, second fluid line, and pump tube defining a fluid passageway from the fluid connector to the common junction block; and the common junction block including means for defining a minimum volume chamber, the minimum volume chamber defining at least one truncated cone-shaped volume, channel means for receiving an end of the second fluid line to provide fluid communication between the minimum volume chamber and the second fluid line, and exit port means for providing a path for fluid communication external the junction block.

17. A fluid communication device for a high speed bulk compounder comprising:

a plurality of first fluid lines, each said first fluid line connecting a respective fluid connector to a respective first pump fitting providing a fluid path therebetween;

a plurality of pump tubing segments maintained in tension connecting each said respective first pump fittings to respective second pump fittings furnishing a fluid path therebetween;

a plurality of second fluid lines, each said second fluid line connecting each said respective second pump fitting to a common junction block; and said common junction block including a fluid passageway in fluid communication with each said second fluid line, a chamber in fluid communication with the fluid passageway, and exit port means therein communicating with said chamber for providing a path for further fluid communication external said junction block, the chamber being at substantially right angles to the second fluid lines and defining a substantially truncated cone shaped volume.

18. A fluid communication device for a high speed bulk compounder comprising:

a plurality of first fluid lines, each said first fluid line connecting a respective fluid connector to a respective first pump fitting providing a fluid path therebetween;

a plurality of pump tubing segments maintained in tension connecting each said respective first pump fittings to respective second pump fittings furnishing a fluid path therebetween;

a plurality of second fluid lines, each said second fluid line connecting each said respective second pump fitting to a common junction block; and said common junction block including a fluid passageway in fluid communication with each said second fluid line, a chamber in fluid communication with the fluid passageway, and exit port means therein communicating with said chamber for providing a path for further fluid communication external said junction block, the chamber defining two substantially truncated cone shaped volumes.

19. A fluid communication device for providing quick and accurate delivery in a bulk compounder comprising:

a plurality of first fluid lines, each said first fluid line sealingly connecting a respective fluid connector to a respective first pump fitting providing a fluid path therebetween;

a plurality of pump tubing segments maintained in tension sealingly connecting each said respective first pump fittings to respective second pump fittings furnishing a fluid path therebetween;

said pump fittings include gripping means about their periphery adapted to aid in placing and maintaining said pump tubing segments in constant tension;

at least one of each set of first and second pump fittings is coded to provide proper orientation to a respective coded operative position for correct use;

a plurality of second fluid lines, each said second fluid line sealingly connecting each said respective second pump fitting to a common junction block; and said common junction block including a fluid passageway in fluid communication with each said second fluid line, a chamber in fluid communication with the fluid passageway, and exit port means therein communicating with said chamber for providing a path for further fluid communication external said junction block, the chamber defining two substantially truncated cone shaped volumes.

20. The device as claimed in claim 13 or 19 wherein:

said plurality of first fluid lines includes three first fluid lines, each said first fluid line sealingly connecting each said respective fluid connector to each said respective first pump fitting providing a fluid path therebetween;

said plurality of pump tubing segments including three pump tubing segments sealingly connecting each said respective first pump fitting to each said second pump fitting furnishing a fluid path therebetween; and said plurality of second fluid lines includes three second fluid lines, each said second fluid line sealingly connecting each said second pump fitting to said common junction block.

21. The device as claimed in claim 13 or 19 wherein said pump tubing segments are elastomeric bodies from about four inches long to about six inches long adapted to be placed in tension around associated rollers of respective peristaltic pumps to achieve fluid flow therethrough.

22. The device as claimed in claim 13 or 19 wherein:

said fluid passageway includes substantially parallel, spaced ports for receiving said second fluid lines and maintaining said second fluid lines in a substantially parallel, spaced relation to prevent crimping; and said exit port means is adapted to sealingly receive a further fluid connector proximate the exterior of said common junction block to provide a path for fluid communication external said junction block.

23. The device as claimed in claim 13 or 19 wherein each of said second fluid lines is of a different length.

24. A fluid communication device for use with a high speed bulk compounder including at least one roller comprising:

a first fluid line extending from a fluid connector;

a second fluid line extending from a common junction block;

a pump tube including pump fitting means for securing the pump tube around the roller in a tensioned state;

the first fluid line, second fluid line, and pump tube defining a fluid passageway from the fluid connector to the common junction block; and the common junction block including means for defining a minimum volume chamber, channel means for receiving an end of the second fluid line to provide fluid communication between the minimum volume chamber and the second fluid line, and exit port means for providing a path for fluid communication external the junction block, the common junction block further including a closure to cover said port means to prevent particulate matter from accumulating thereon, said closure including a retaining ring securing said closure to said common junction block and a flexible member connecting said retaining ring to said closure and said closure, flexible member, and retaining ring lying in substantially the same plane when said exit port means is uncovered.

25. The device as claimed in claim 1 or 24 wherein the internal portion of said closure faces downward when not covering said exit port means to prevent the gathering of any particulate contamination thereon.

26. The device as claimed in claim 25 wherein said flexible member is rotatable to enable said closure to cover said exit port means with said closure.

27. The device of claims 14, 16 or 24 including a plurality of first fluid lines, second fluid lines, and pump tubes.

28. The device of claims 16 15, or 24 wherein the pump fitting means includes gripping means for facilitating the positioning of the pump tube around the roller.

29. The apparatus of claim 24 wherein said minimum volume chamber defines at least one truncated cone shaped volume.

* * * * *